US005997285A

United States Patent [19]

Carbone et al.

[11] Patent Number: 5,997,285

[45] Date of Patent: Dec. 7, 1999

[54] BURNER HOUSING AND PLENUM CONFIGURATION FOR GAS-FIRED BURNERS

[75] Inventors: Philip Carbone, North Reading; Karen Benedek, Winchester; Michael J. Farina, Waltham; Stephan Schmidt, Winchester, all of Mass.

[73] Assignee: Gas Research Institute, Chicago, Ill.

[21] Appl. No.: 08/912,483

[22] Filed: Aug. 18, 1997

Related U.S. Application Data

[60] Provisional application No. 60/024,170, Aug. 19, 1996.

[51] Int. Cl.[6] ..... F23D 14/02

[52] U.S. Cl. ..... 431/354; 431/326

[58] Field of Search ..... 431/326, 328, 431/354, 355; 126/92 AC, 91 A; 239/424.5, 566

[56] References Cited

U.S. PATENT DOCUMENTS

| | | | |
|---|---|---|---|
| 2,849,220 | 8/1958 | Duffey et al. | 263/42 |
| 3,170,504 | 2/1965 | Lanning | 158/116 |
| 3,326,201 | 6/1967 | Murray | 126/25 |
| 3,814,576 | 6/1974 | Brockhurst | 431/354 |
| 4,014,316 | 3/1977 | Jones et al. | 126/360 |
| 4,063,873 | 12/1977 | Naito | 431/328 |
| 4,097,224 | 6/1978 | Cooksley | 431/355 |
| 4,154,861 | 5/1979 | Smith | 426/466 |
| 4,187,835 | 2/1980 | Finney | 126/360 |
| 4,355,973 | 10/1982 | Bailey | 432/209 |
| 4,424,793 | 1/1984 | Cooperrider | 126/110 |
| 4,674,973 | 6/1987 | Wright | 431/284 |
| 4,676,737 | 6/1987 | Suzuki et al. | 431/328 |
| 4,830,600 | 5/1989 | VerShaw et al. | 431/8 |
| 4,869,230 | 9/1989 | Fletcher et al. | 126/91 |
| 5,057,007 | 10/1991 | Andringa et al. | 431/328 |
| 5,090,899 | 2/1992 | Kee | 431/326 |
| 5,361,750 | 11/1994 | Seel et al. | 126/91 |
| 5,429,112 | 7/1995 | Rozzi | 126/116 |

*Primary Examiner*—Ira S. Lazarus
*Assistant Examiner*—Sara Clarke
*Attorney, Agent, or Firm*—Pauley Petersen Kinne & Fejer

[57] ABSTRACT

A burner apparatus for gas-fired appliances, such as gas furnaces. The burner apparatus includes an improved flame holder structure, with a contoured surface, for controlling the shape and contour of the flame, and burner housing and plenum configurations for enhancing the characteristics of the flame.

6 Claims, 17 Drawing Sheets

| | # OF HOLES | RADIUS | POSITION |
|---|---|---|---|
| 1 | 1 | 0.000 | 0 |
| 2 | 6 | 0.085 | 0 |
| 3 | 12 | 0.142 | 0 |
| 4 | 12 | 0.198 | 0 |
| 5 | 12 | 0.255 | 0 |
| 6 | 12 | 0.287 | 9.83 |
| 7 | 12 | 0.287 | 350.17 |
| 8 | 12 | 0.312 | 0 |
| 9 | 12 | 0.343 | 8.21 |
| 10 | 12 | 0.343 | 351.79 |
| 11 | 12 | 0.368 | 0 |
| 12 | 12 | 0.425 | 0 |
| 13 | 12 | 0.456 | 6.18 |
| 14 | 12 | 0.456 | 353.82 |
| 15 | 12 | 0.482 | 0 |
| 16 | 12 | 0.512 | 5.50 |
| 17 | 12 | 0.512 | 354.50 |
| 18 | 12 | 0.538 | 0 |
| 19 | 24 | 0.595 | 0 |
| 20 | 24 | 0.625 | 4.50 |
| 21 | 24 | 0.625 | 355.50 |
| 22 | 24 | 0.651 | 0 |
| 23 | 24 | 0.682 | 4.13 |
| 24 | 24 | 0.682 | 355.87 |
| 25 | 24 | 0.708 | 0 |
| 26 | 48 | 0.772 | 0 |

TOTAL NUMBER OF PORTS = 415
PORT DIAMETER = 0.040"
TOTAL OPEN AREA = 0.522 sq.in.
PORT LOADING @ 25kBtu/hr = 48kBtu/hr-sq.in.

| | # OF HOLES | RADIUS | POSITION |
|---|---|---|---|
| 1 | 1 | 0.000 | 0 |
| 2 | 6 | 0.188 | 0 |
| 3 | 12 | 0.313 | 15 |
| 4 | 12 | 0.438 | 0 |
| 5 | 24 | 0.615 | 0 |
| 6 | 24 | 0.729 | 7.5 |

TOTAL = 79

TOTAL NUMBER OF PORTS = 79

PORT DIAMETER = 0.081"

TOTAL OPEN AREA = 0.407 sq.in.

BURNER HOUSING AND PLENUM CONFIGURATION FOR GAS-FIRED BURNERS

This application depends from and claims priority under 35 U.S.C. §119(e) of U.S. Provisional Application No. 60/024,170, filed Aug. 19, 1996, the disclosure of which is incorporated herein by reference.

BACKGROUND OF THE INVENTION

1. The Technical Field

The present invention relates to gas burner apparatus, and in particular, to burner housings and plenum configurations for use with gas-fired burners, such as may be used in gas furnaces for the thermal conditioning of residential or other occupied spaces.

2. The Prior Art

Gas burners, and burner housings, plenums and heat exchangers exist in a variety of configurations, depending upon the type of burner function contemplated. For example, there are gas burners and housings which are designed for radiant heating operation, in which the gas flame is contemplated to more or less reside on the surface of the burner plate or flame holder. Other burner/housing/plenum configurations are designed to provide for controlled flow of the gas and/or combustion air which is being projected through the burner plate, and the flame is contemplated as being positioned in a stable manner, extending for some distance from the burner plate or flame holder.

Regardless of the particular type or intended function of the burner apparatus, all have certain common goals in their design. These include: 1) quiet operation; 2) a stable flame; 3) efficient transfer of the heat generated to the desired destination, whether it is a particular surface, as in a heat exchanger, or directly to a mass of air or other fluid; and 4) complete combustion.

One example of a prior art burner apparatus is disclosed in Naito, U.S. Pat. No. 4,063,873 . The *Naito* '873 reference discloses an infrared gas burner plate, having a plurality of diamond-shaped depressions and projections. A number of apertures for combustion air and gas are distributed throughout the inclined surfaces of the depressions and projections. All of the apertures are the ends of parallel passageways through the burner plate, and each aperture has a diameter which is substantially less than the length of its associated passageway.

It would be desirable to provide a burner housing and plenum configuration which is configured to help maintain a stable flame, for blue flame combustion operation, over a wide range of firing rates and fuel/air ratios.

An additional desirable feature would be to provide a burner housing and plenum configuration which helps promote a quieter, improved flame geometry, with reduced flame spread and reduced tendency of the flame to impinge upon the side walls of heat exchanger structures, thereby lowering heat exchanger temperature and reducing CO generation.

It would additionally be desirable to provide a such burner apparatus as a fully premixed burner apparatus.

Still another object of the invention would be to provide such a burner apparatus which would be suitable for use in gas furnace environments.

These and other objects of the invention will become apparent in light of the present specification, claims and drawings.

SUMMARY OF THE INVENTION

The present invention comprises a burner plenum, for use with a burner apparatus. The burner plenum is configured for receiving combustion air and gaseous fuel from a gaseous fuel manifold, which is then mixed for delivery to a desired location for ignition. Such ignition results in the production of a stabilized flame for providing heat to be transferred to a location remote from the burner apparatus.

The burner plenum comprises a plurality of side walls, defining an interior volume; an inlet plate, connected to the side walls of the burner plenum, at one end thereof, and having means for enabling injection of gaseous fuel from at least one gaseous fuel outlet into the interior volume of the burner plenum. The inlet plate further has means for enabling ambient air to be drawn into the interior volume of the burner plenum by a suction source downstream of the burner plenum into the interior volume of the burner plenum.

The inlet plate member further comprises a plate member; at least one gas inlet aperture disposed in the plate member, for receiving therethrough a jet of gaseous fuel being emitted from at least one gaseous outlet of a gaseous fuel manifold; and a plurality of air inlet apertures, substantially surrounding each at least one gas inlet aperture, so that ambient air is drawn, by a source of suction downstream of the burner plenum, through the plurality of air inlet apertures, into the burner plenum.

The side walls defining the interior volume of the burner plenum, further comprise an mixing region having a substantially constant width and a substantially constant thickness. A pressure recovery region, disposed downstream from the mixing region, has a substantially constant width and a substantially continuously increasing thickness. The side walls of the burner plenum defining the pressure recovery region are operably configured for association with a burner plate, for directing mixed gaseous fuel and combustion air to the burner plate.

In an embodiment, the burner plenum further comprises a baffle member, positioned within the pressure recovery region of the interior volume, for facilitating distribution of the mixed gaseous fuel and combustion air across the width of the burner plenum, in turn, for facilitating distribution of the mixed fuel and air across a burner plate disposed in an outlet region of the burner plenum.

The present invention also comprises a heat exchanger apparatus, for use in association with a gaseous fuel-fired burner, for enabling the transfer of heat developed by the combustion of gaseous fuel, to a fluid to be heated.

In such an embodiment, the heat exchanger apparatus comprises a heat exchanger shell, configured for the passage therethrough of a fluid to be heated and at least one heat exchanger tube, operably positionable in juxtaposition to a gaseous fuel-fired burner. The heat exchanger tube receives a flame from a gaseous fuel-fired burner, and also receives and transmits therethrough the combustion products from such flame.

The at least one heat exchanger tube is preferably positioned within the heat exchanger shell so that a fluid to be heated is permitted to pass by and around it. The at least one heat exchanger tube may be configured to facilitate the transfer of heat from a flame and the combustion products thereof while precluding escape of combustion products into the fluid to be heated.

The at least one heat exchanger tube may further include means for facilitating transfer of heat therethrough while increasing velocity of the combustion products therethrough.

The heat exchanger tube comprises at least one inlet, disposed on an outer surface of the heat exchanger shell, connecting one end of the at least one heat exchanger tube to an outer surface of the heat exchanger shell, and at least one outlet, disposed on the outer surface of the heat exchanger shell, at a position substantially remote from the inlet, connecting another end of the at least one heat exchanger tube to the outer surface of the heat exchanger shell.

The heat exchanger tube may further comprise a first elongated, substantially straight section, having a substantially constant transverse cross-sectional configuration. The first elongated section substantially adjoins the at least one inlet. A second arcuate section adjoins the first section and the at least one outlet. This arcuate section has a transverse cross-sectional configuration which decreases in area, proceeding from the first elongated section to the at least one outlet.

In an embodiment of the invention, the first elongated section is positioned in an upstream position within the heat exchanger shell, relative to the second arcuate section. The second arcuate section is convexly curved toward the first elongated section.

The heat exchanger tube transverse cross-sectional configuration in each of the first and second sections preferably has a width, transverse to the flow of the fluid being heated around the heat exchanger tube, which is less than the length of the transverse cross-sectional configuration, in a direction substantially parallel to the flow of the fluid being heated around the heat exchanger tube. The heat exchanger tube transverse cross-sectional configuration may be substantially elliptical substantially along its length.

The means for facilitating heat transfer while increasing velocity of the combustion products comprises one or more indentations in the surface of the heat exchanger tube, in the second arcuate section, proximate an outlet region of the heat exchanger tube.

BEST MODE FOR CARRYING OUT THE INVENTION

Figure 1:
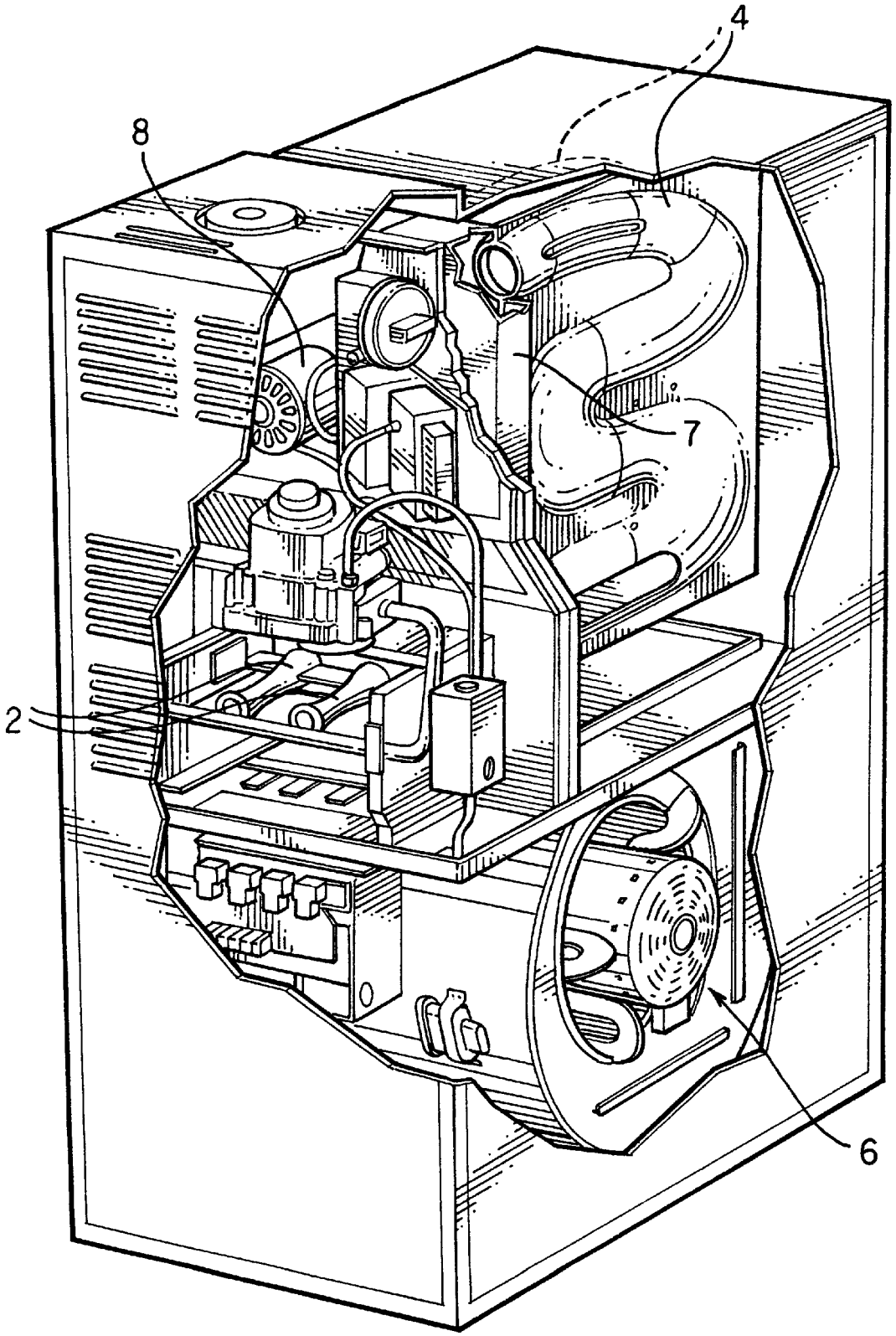
FIG. 1 PRIOR ART
FIG. 1 is a perspective view of a prior art warm air furnace, showing the general burner plenum and heat exchanger configurations.

While this invention is susceptible of embodiment in many different forms, there is shown in the drawings and will be described herein in detail, several embodiments, with the understanding that the present disclosure is to be considered as an exemplification of the principles of the invention and is not intended to limit the invention to the embodiments illustrated.

FIG. 1 illustrates a prior art conventional warm air furnace, having a pair of in-shot burners 2, which fire into a pair of serpentine heat exchangers 4. The heat exchangers typically will have 2, 3 or more turns, and may have a decreasing interior cross-sectional area. The air to be heated passes upwardly around the heat exchangers, propelled by circulation fan 6. After passing through the heat exchangers, the combustion gases are collected in a collection box 7, being drawn by an inducer fan 8, and on to a flue or chimney, in a manner well known in the art.

The present invention is directed to burner apparatus, in particular fully premixed, gas-fired, induced draft burners, configured to fire into tubular or clamshell-type heat exchangers, such as are found in residential warm air furnaces.

Figure 2:
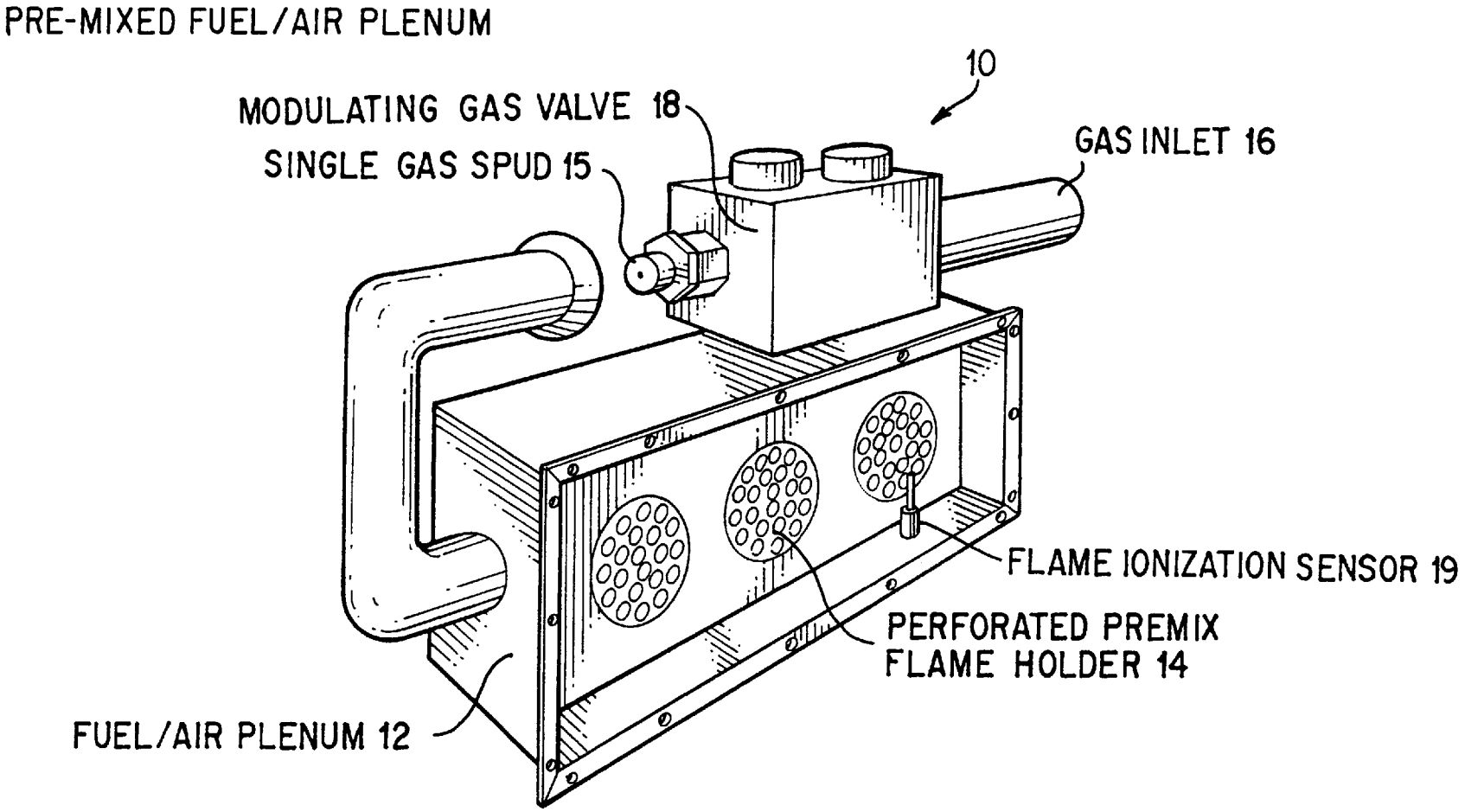
FIG. 2 is a perspective view of a burner apparatus according to one embodiment of the invention.

FIG. 2 illustrates, according to one embodiment of the present invention, a gas burner/plenum 10, in accordance with the principles of the present invention, as might be used in a gas furnace for a domestic residence or other occupied space. Gas burner/plenum 10 is of the premixed gas/air variety, in which the fuel gas and all of the intended combustion air is premixed in an inlet plenum 12, prior to ignition of the gas and air. Burner/plenum 10 includes a plurality of perforated flame holders 14 which are each fed by gas spud 15.

In an embodiment of the invention, gas is delivered to burner/plenum 10 by inlet 16, and regulated through a gas valve 18, which may be a conventional gas valve, a stepped valve or even a modulating gas valve. In order to enable control of the combustion process, a flame sensor 19 (FIGS. 2 and 3) is provided which senses the stoichiometry of the flame, as a function of the degree of ionization in the flame. While conventional control methods for regulating the operation of the valve may be used, one suitable control method for regulating the operation of a gas burner may be found in copending U.S. Ser. No. 08/747,777, filed Nov. 13, 1996, the complete disclosure of which is incorporated herein by reference.

Figure 3:
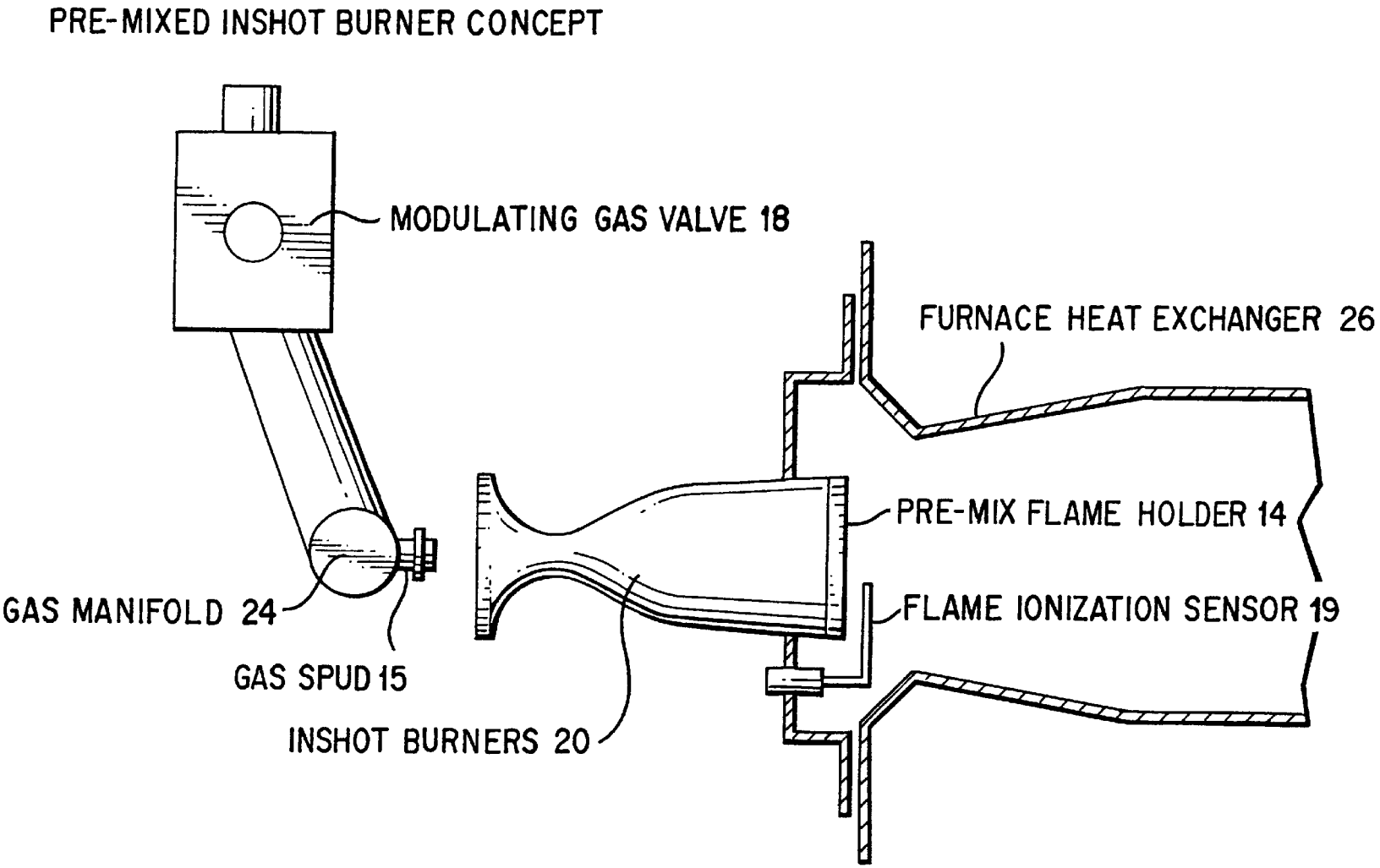
FIG. 3 is a schematic view of a burner apparatus system, suitable for use in the environment of the present invention.

FIG. 3 illustrates schematically an alternative burner configuration, in which one or more inshot burners 20, each having a flame holder 14, which will be supplied gas and combustion air by corresponding one or more respective gas spuds 15, each of which is associated with a manifold 24. Each of the burners 20 opens to a heat exchanger 26, for delivery of the heat generated by the combustion process.

Figure 4:
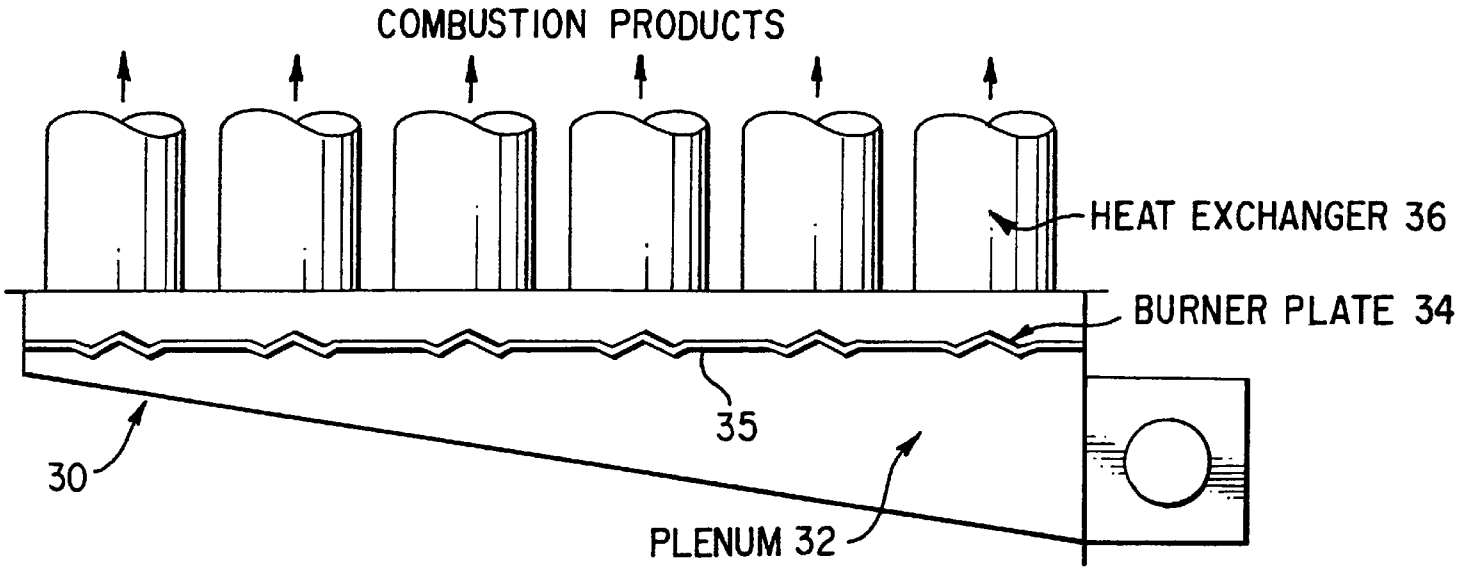
FIG. 4 is a top plan view of one embodiment of a burner apparatus incorporating a burner plate of the present invention, showing a contemplated inlet plenum configuration.
Figure 5:
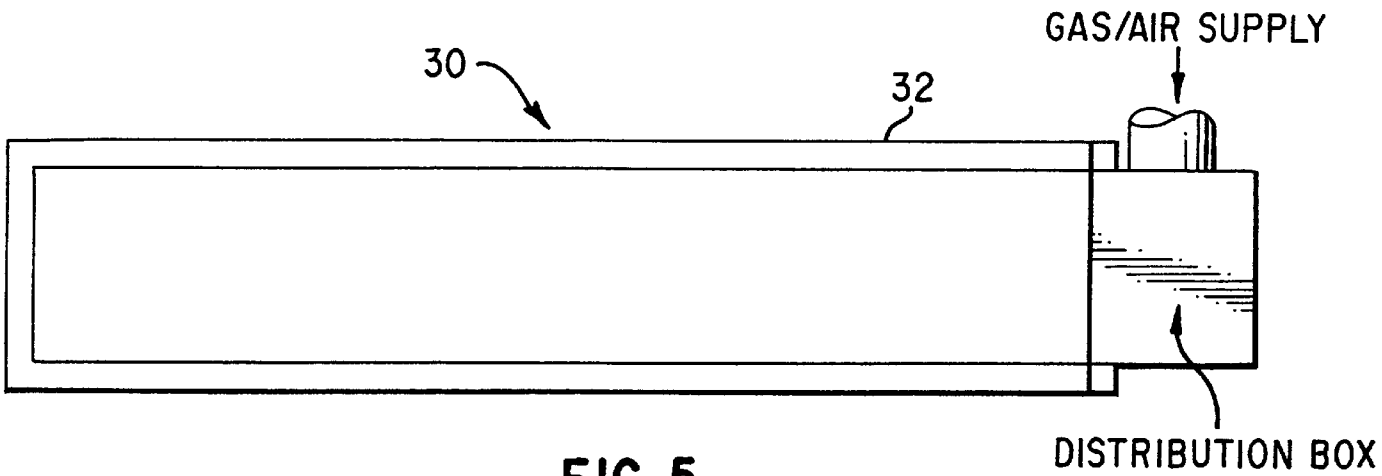
FIG. 5 is a front view of the burner apparatus and inlet plenum configuration, according to the embodiment of FIG. 4.

FIGS. 4 and 5 illustrate a burner/plenum configuration 30, having a side feed plenum 32. Plenum 32 may have a trapezoidal cross-sectional plan configuration, as indicated in FIG. 4. Burner plate (flame holder) 34 is positioned in the side of plenum 32 which opens onto the furnace heat exchanger 36. Baffle plate 35 is positioned immediately upstream of burner plate 34. After passing through the furnace heat exchanger 36, the combustion products are directed to a suitable flue or chimney out of the occupied space.

Figure 5A:
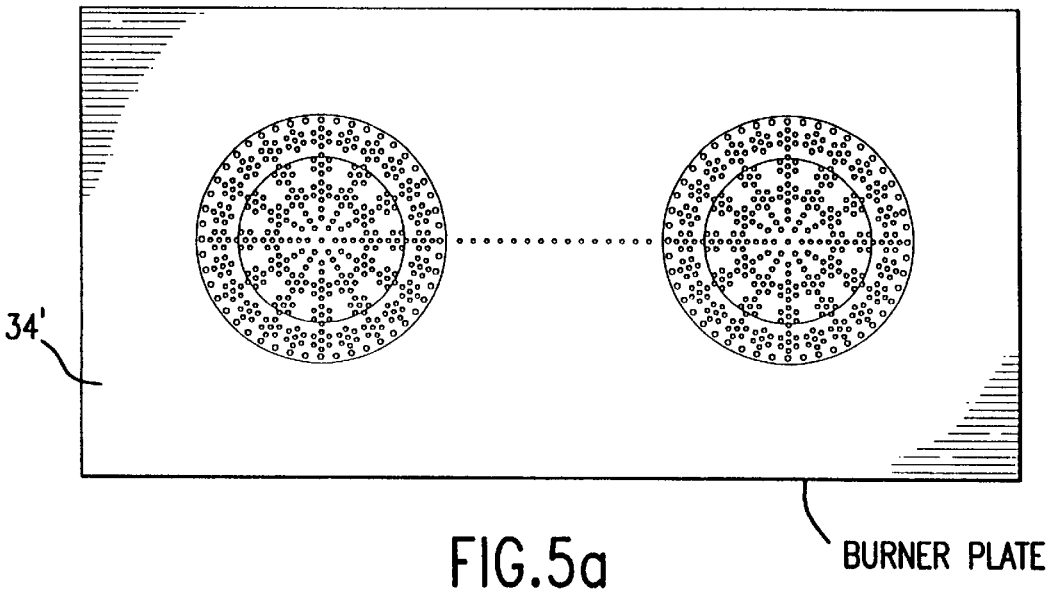
FIG. 5*a* is a plan view of a burner plate, according to another embodiment of the present invention.
Figure 5B:
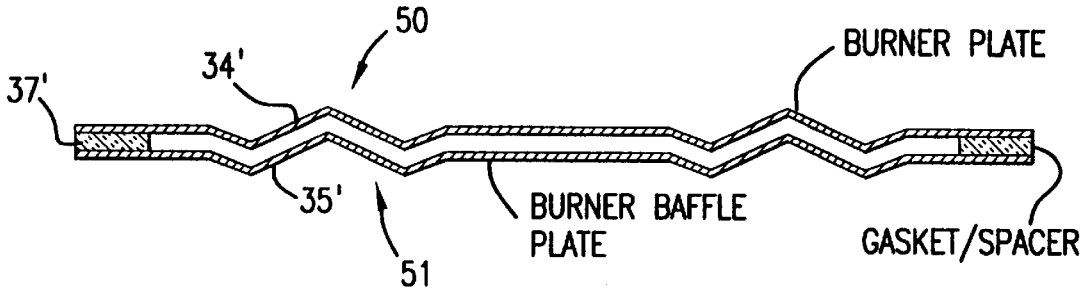
FIG. 5*b* is a side elevation of the burner plate and a corresponding baffle plate, according to the embodiment of FIG. 5*a*.
Figure 5C:
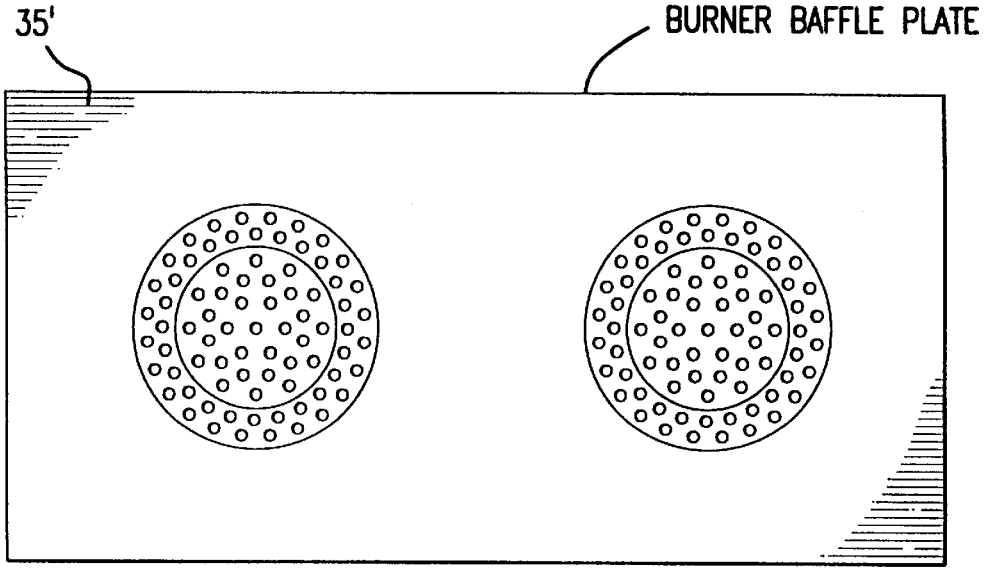
FIG. 5*c* is a plan view of the baffle plate corresponding to the burner plate of FIG. 5*a*.

FIGS. 5*a*–5*c* illustrate a burner plate 34' and a baffle plate 35', in accordance with the principles of the present invention, having preferred porting configurations. Plates 34' and 35' are configured for two flame holder regions each. If a greater or lesser number of flame holder regions are desired (as shown in the other embodiments described herein), then plates 34' and 35' may simply be suitably shortened or lengthened, in accordance with conventional design principles by one of ordinary skill in the art having the present disclosure before them.

However many flame holder regions are provided, each burner plate (e.g., 34') and its corresponding baffle plate (e.g., 35') will have substantially identical profiles, as shown in FIG. 5*b*. Gasket/spacer members 37' will be positioned between burner plate 34' and baffle plate 35'.

The baffle plate is believed to provide assistance for distributing the mixed fuel gas and air across the width of the burner plate, and to assist in pressure recovery of the mixed fuel gas and air. The presence of the baffle plate is further believed to help reduce CO production, and to facilitate burner ignition.

Figure 6:
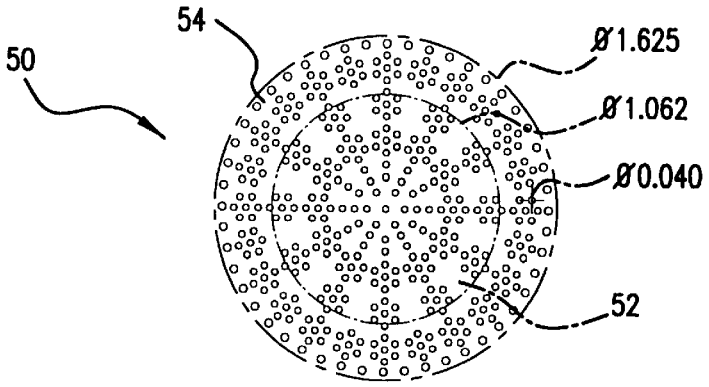
FIG. 6 is a plan view of a flame holder configuration, according to a preferred embodiment of the invention.
Figure 7:
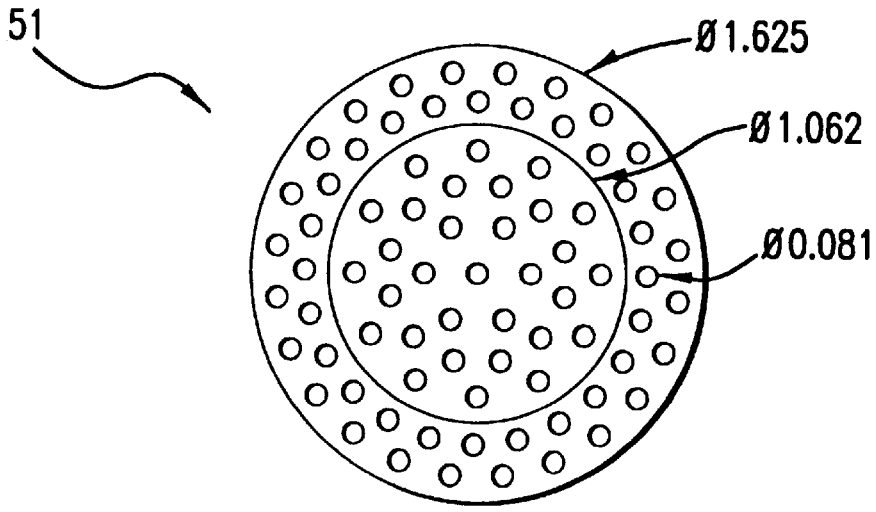
FIG. 7 is a plan view of a burner plate configured to accompany the flame holder configuration of FIG. 6.

FIGS. 6 and 7 illustrate the preferred port locations and patterns for the flame holder region of a burner plate and its corresponding baffle plate region, in accordance with the principles of the present invention, for a desired port loading and burner rating. Although specific aperture sizes and locations are given, such values may be modified as necessary for a given application, by one of ordinary skill in the art having the present disclosure before them.

Figure 8:
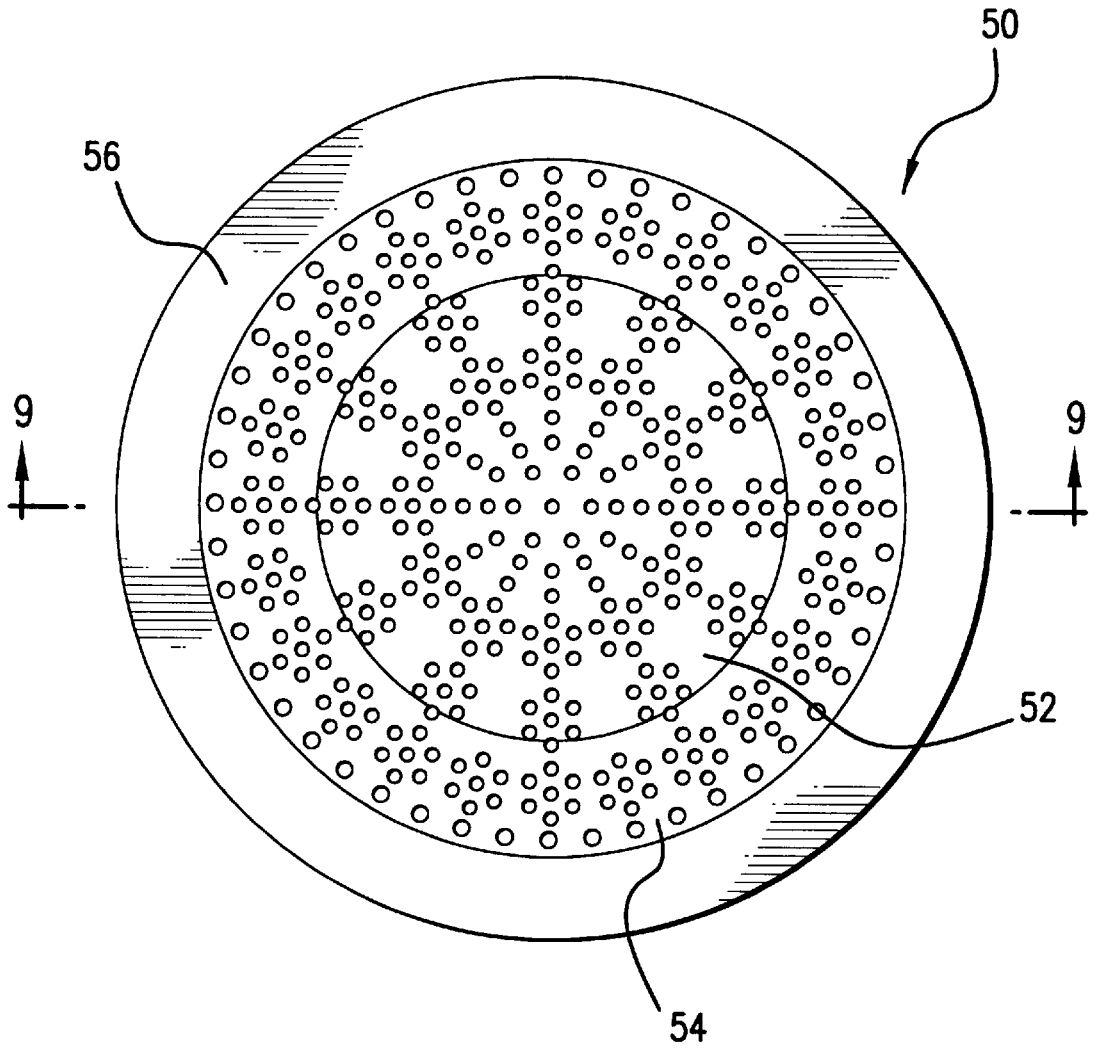
FIG. 8 is a further top plan view of the flame holder configuration of FIG. 6.
Figure 9:
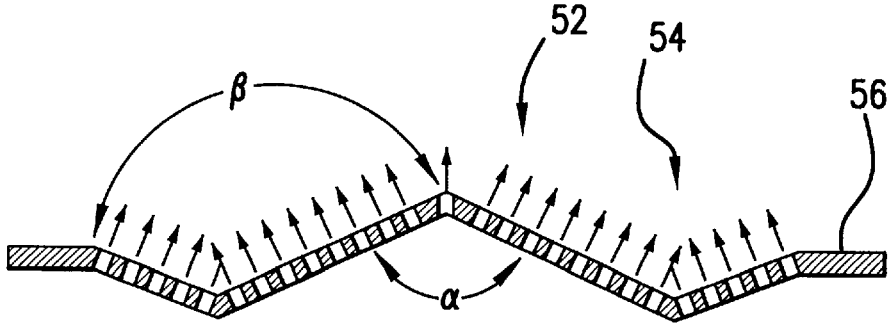
FIG. 9 is a side elevation of the flame holder configuration of FIG. 8, illustrating the mixed gas flow paths.

FIGS. 8 and 9 illustrate a preferred flame holder region configuration for a burner plate in accordance with the principles of the present invention. Flame holder region 50 may be a flame holder for a single flame burner plate, or as previously indicated, two or more flame holder regions 50 may be formed on a single elongated burner plate. If a plurality of flame holder regions are provided, one or more rows of apertures will be provided to connect the separate flame holder regions, to enable cross-lighting from one flame holder region to the other. Each flame holder region 50 preferably is circular and in the form of a convex (outwardly pointing) cone, placed within a conical depression. As seen in FIGS. 8 and 9, each flame holder region 50 comprises upwardly/outwardly projecting conical portion 52, set within conical depression portion 54, which, in turn, is surrounded by a flat region 56. Each flame holder region 50 is provided with a plurality of apertures, which may be provided in the preferred pattern illustrated, and having the dimensions and locations provided in FIG. 6.

Preferably, the side profile of the flame holder region of FIGS. 8 and 9, has a center convex cone having an included angle alpha in the range of approximately 110° to 150°, preferably 130°, and an outer concave conical ring, defining an angle beta, as shown in FIG. 9, in the range of the focus of which has an included angle beta in the range of 155° to 115°, preferably 135°. The apertures are preferably of the same diameter, although the outermost single ring of apertures may be of a slightly larger diameter. The apertures should have a diameter between 0.060" as a maximum, and the burner plate thickness, as a minimum.

The angles of the profile of the port region 51 of baffle plate(s) 35, 35' will be the same as the corresponding angles of flame holder region 50 of burner plates 34, 34'.

Whether having only a single flame holder region or a plurality of flame holder regions, the burner plate is formed from a thin plate (preferably in the range of 0.024"–0.032" thick), relative to its length or width. A preferable method for manufacture of such a burner plate would be to take a flat plate, and form the holes by drilling or punching. Afterward, the conical forms are created by further stamping. As such, the holes have diameters which are the same general order of magnitude as the thickness of the plate and, in turn, the lengths of the passages through the plate. The loading on each port can be in the range of 5000–70000 Btu/hr in$^2$, with a preferred maximum loading, for the configuration illustrated in FIG. 8, of 50000 Btu/hr in$^2$. The burner plate is designed to achieve the desired port loading, with a minimum material thickness between the apertures equal to approximately the radius of the apertures.

The flow pattern of the gases as they exit the flame holder region is as illustrated in FIG. 9. Once the plate has been stamped or otherwise formed, after the apertures have been drilled, to have the conical profile shown in FIG. 9, the fluid flow through the plate, at any given location in the flame holder region, is generally perpendicular to the immediately surrounding plate surface at that given location. This is believed to possibly be the result, at least in part, of the fact that the side walls of the individual apertures are, after stamping or other forming, likewise generally perpendicular to the immediately surrounding plate surface at that given location. The flow of the gases, from the central portion (the elevated cone) 52 is upwardly and radially outward, with the exception of the aperture at the precise apex of the cone. In the conical depression region 54 surrounding the upraised cone 52, the flow is upward and radially inward. This has the effect of directing the individual flamelet groups around the periphery of the flame holder region toward the center of the flame, and away from the side walls of the heat exchanger. This helps prevent impingement of the outer flamelet groups against the side walls, and the resultant quenching, caused by sudden heat loss, of those flamelet groups which might otherwise occur upon such contact. In turn, this flame holder construction helps keep the periphery of the flame hot, which helps aerodynamically stabilize the overall flame and help prevent flame lift-off from the burner plate.

An additional feature which is believed to assist in the improvement of the flame characteristics is the clustering of groups of apertures. The hexagonal patterns (with apertures in the centers of the hexagons) is believed to impart stability to the individual flamelets and thus maintain a quiet flame. The connecting apertures in between the hexagons help keep the flame shape continuous, and assure complete involvement of all the apertures. A further advantage of the burner configurations of the present invention is that a greater capacity for turndown of heat input (approx. 6:1 or greater) is obtainable, as opposed to conventional burner systems, having partially premixed gas and air (approx. 3:1 max.).

The present invention is also directed to an improved burner housing and plenum configuration, for enhancing the operation of the burner plate apparatus described hereinabove.

Figure 11:
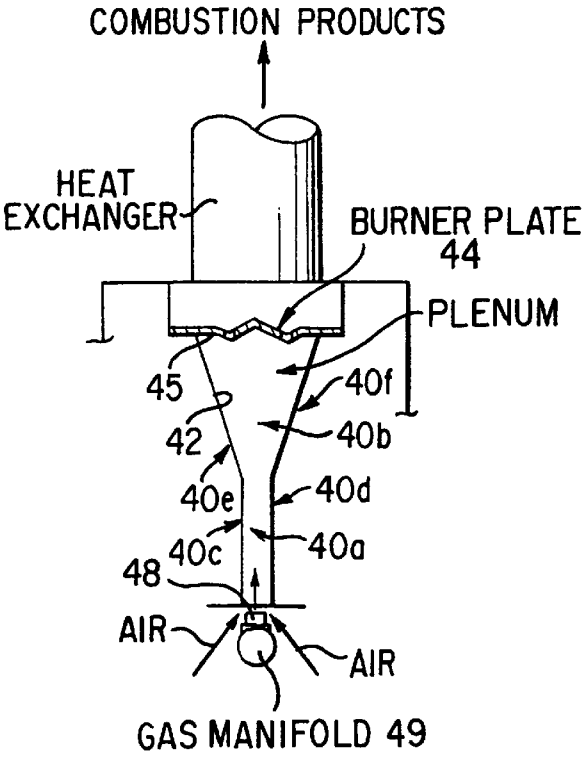
FIG. 11 is an end elevation of the burner/plenum configuration, according to the embodiment of FIG. 10.
Figure 10:
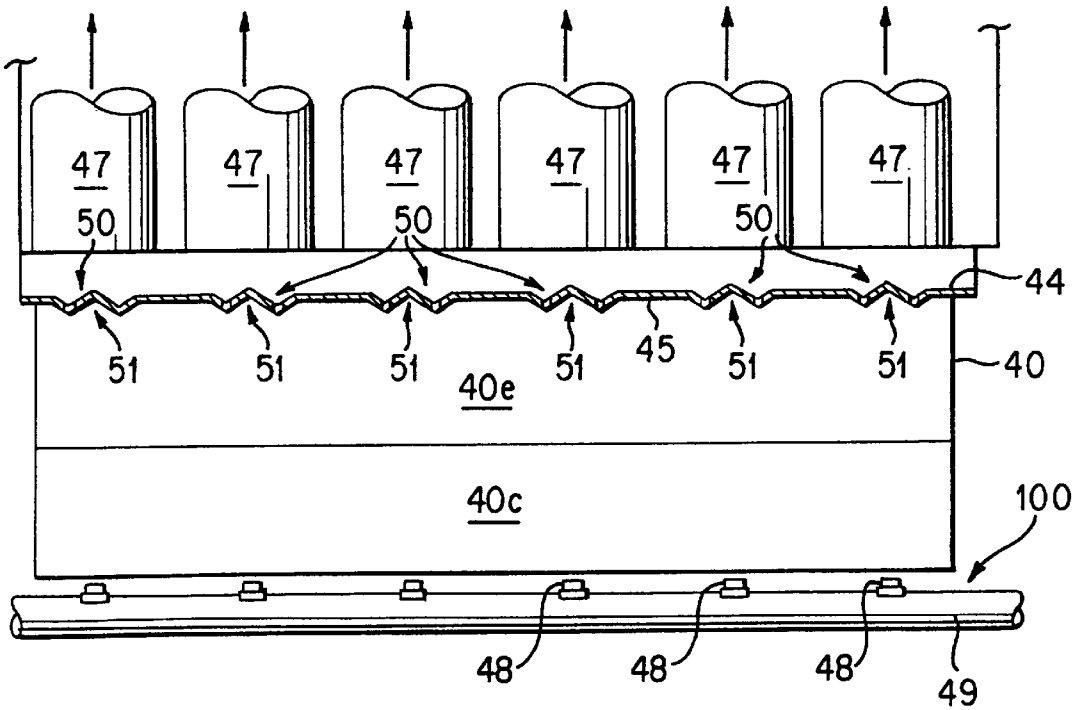
FIG. 10 is a top plan view, in section, of an alternative burner/plenum configuration.

FIGS. 10 and 11, illustrate portions of a burner/plenum configuration having a multiple feed plenum having a gas spud for each burner, wherein each flame holder region 50 of burner plate 44 preferably has the configuration of flame holder region 50 of FIGS. 8–11. Baffle plate 45 likewise has port regions 51, which are preferably the same as illustrated in FIGS. 5*b* and 7.

Plenum housing 40 forms a burner inlet plenum chamber 42. Plenum housing 40 has substantially flat sides, and thus a substantially constant width, and top and bottom walls 40*c* and 40*d*, respectively, having planar portions, defining a narrow mixing region 40*a* having a substantially constant thickness. A pressure recovery region 40*b* is defined by top and bottom walls 40*e* and 40*f*, respectively. Region 40*b* has a triangular cross-section providing a substantially increasing cross-section. As the mixed gases enter region 40*b*, the static pressure of the gases rises, while the dynamic pressure and linear velocity drop. Pressure recovery region 40*b* promotes the distribution of the mixed gases across the height of plenum housing 40.

Figure 12:
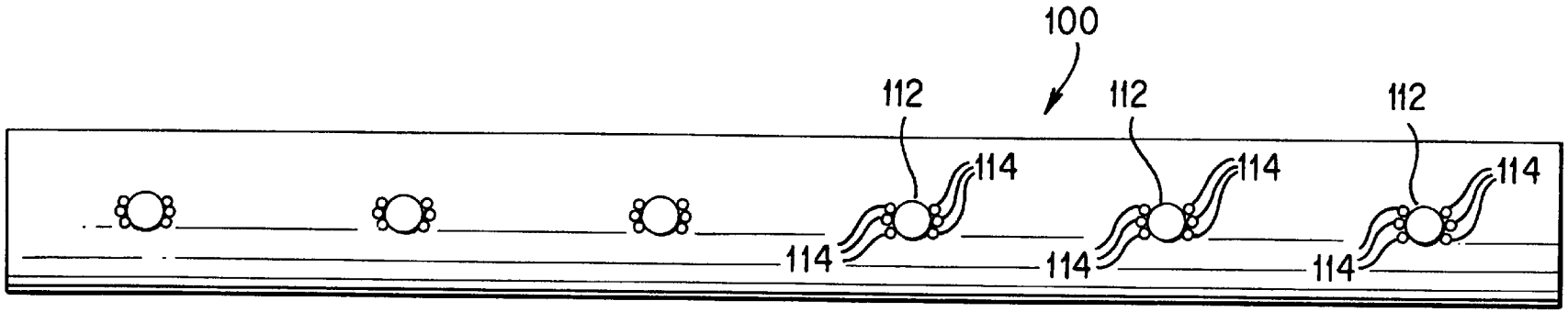
FIG. 12 is a schematic elevation of an air inlet plate configuration contemplated for use with the burner and plenum configurations of FIGS. 10 and 11 of the present invention.
Figure 13:
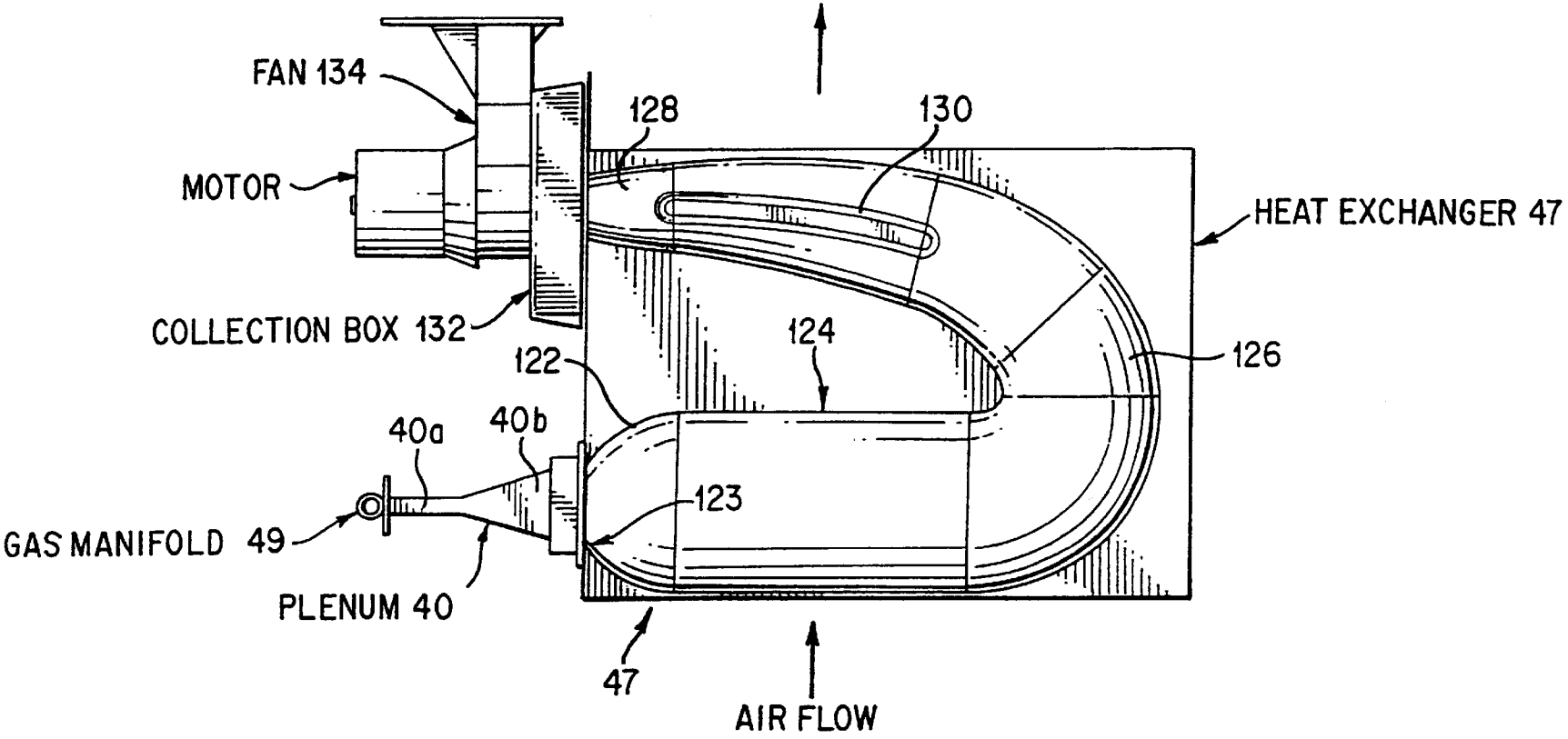
FIG. 13 is a side elevation of a burner plenum, heat exchanger, and inducer fan combination, in accordance with one preferred embodiment of the present invention.
Figure 15:
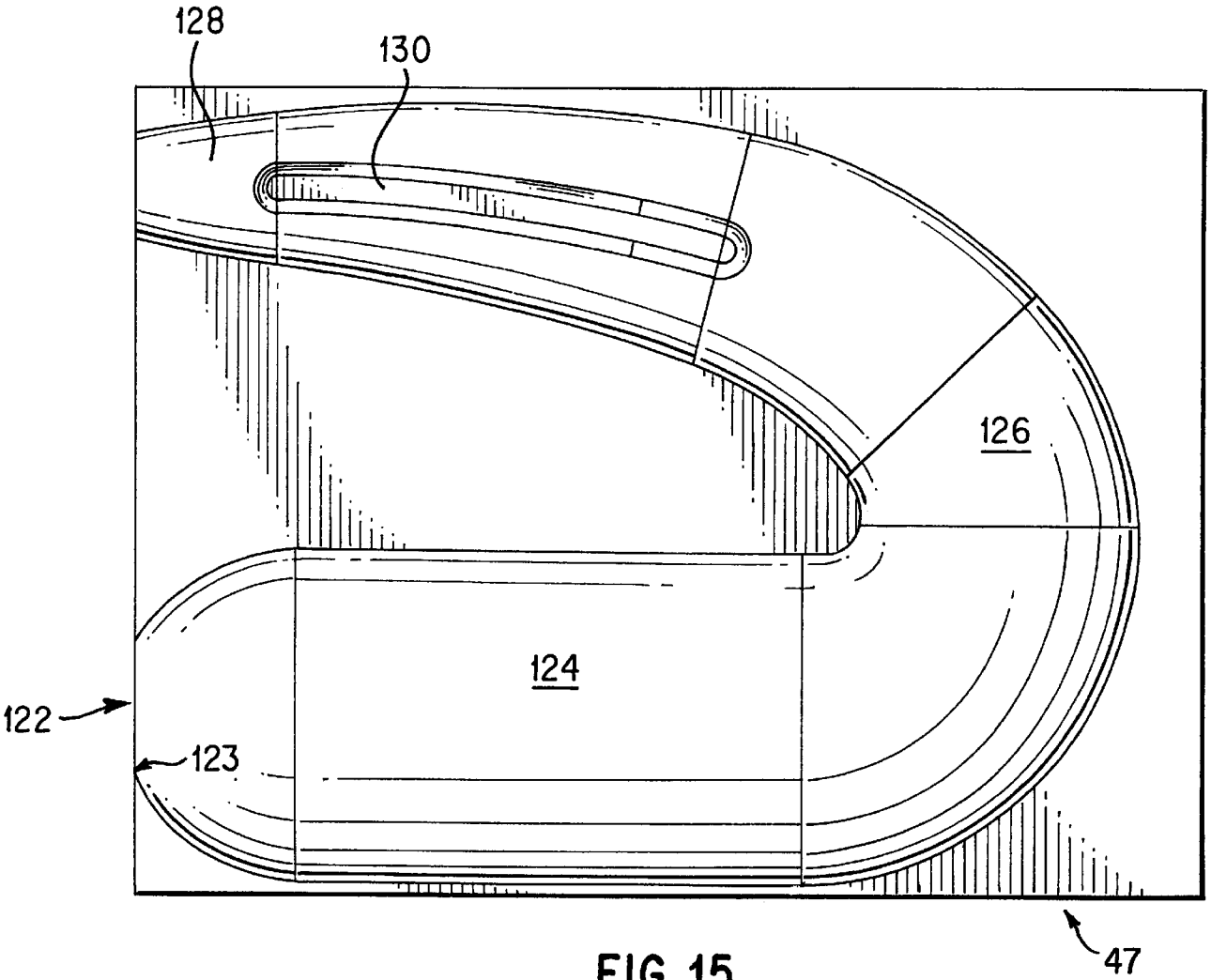
FIG. 15 is a side elevation of the heat exchanger of FIGS. 13 and 14.
Figure 14:
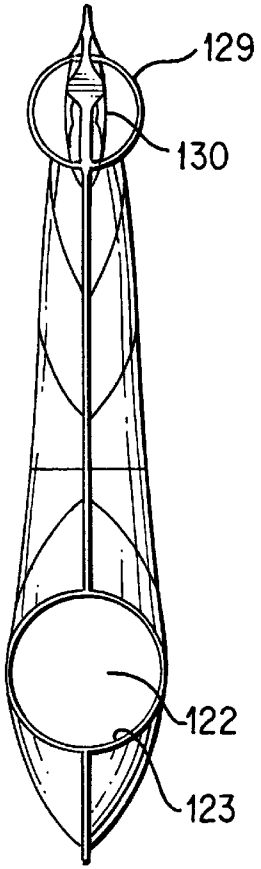
FIG. 14 is an end elevation of the heat exchanger of FIG. 13.
Figure 16:
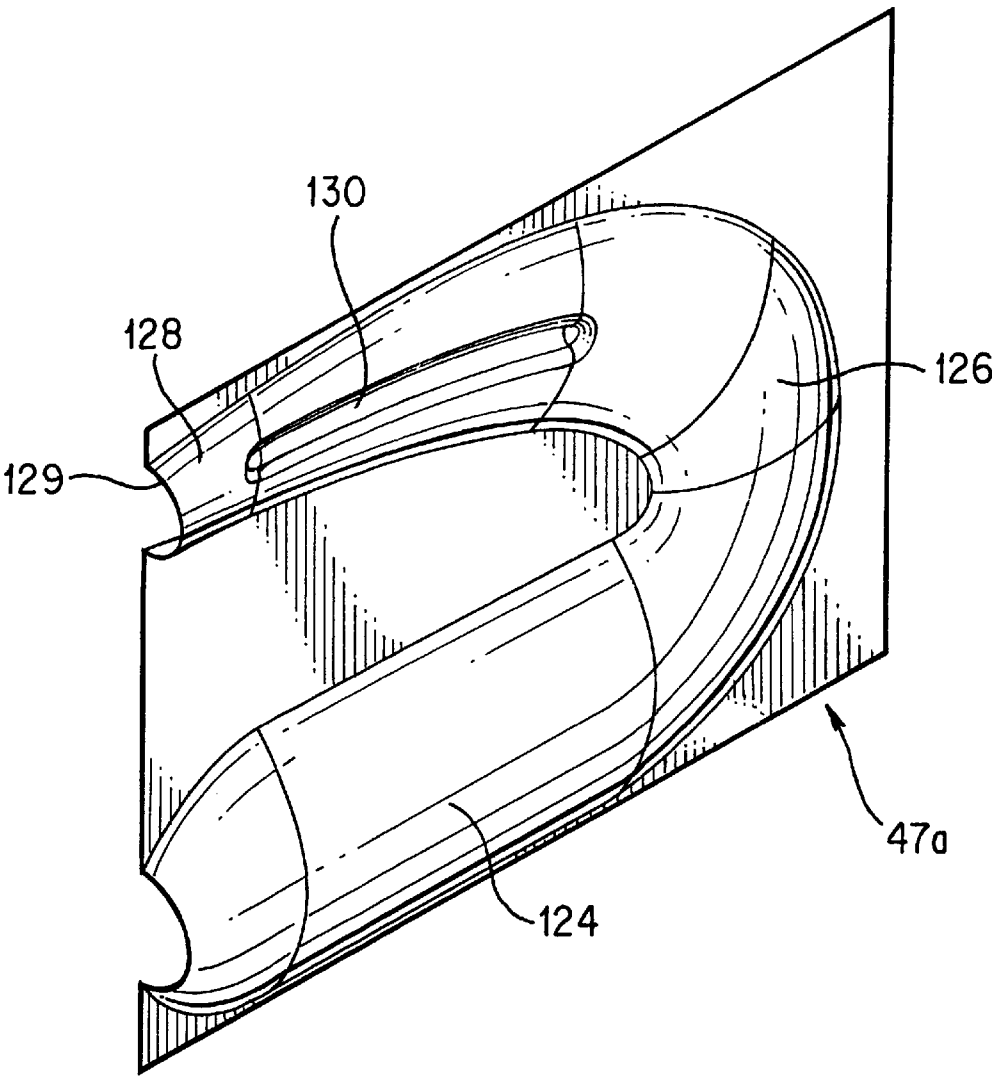
FIG. 16 is a perspective view of one half of a heat exchanger of the embodiment of FIGS. 13–15.

Plenum chamber 42 is faced by baffle plate 45 having port regions 51. Baffle 45 provides a further pressure recovery region, between baffle 45 and burner plate 44, which is less abrupt than that in region 40*b*, promoting further distribution of the gases across the width of burner plate 44. By changing the side-to-side width of housing 40, a greater or lesser number of flame holder regions may be accommodated. Plenum housing 40 is supplied by separate gas spuds 48 opening from a gas manifold 49. The flames from flame holder regions 50 extend into heat exchanger tube(s) 47. FIG. 12 illustrates air inlet plate 100 preferably used in association with the burner construction of FIGS. 8–11. Air inlet plate 100 will be provided with a plurality of fuel inlet apertures 112, which will be positioned so as to be concentric to corresponding ones of gas spuds 48. Surrounding each fuel inlet aperture 112 will be a plurality of air inlet apertures 114. In operation, fuel is expelled, under sufficient pressure, from spuds 48 (FIG. 11) such that the entire stream of fuel gas passes through the respective fuel inlet apertures 112, and into plenum housing 40. Air ambient to the gas spuds 48 is drawn by inducer fan 134 (see FIG. 14) through air inlet apertures 114, to provide the combustion air for premixing in region 40*a*.

Referring to FIGS. 13–17, heat exchangers) 47 are placed in a housing or shell (not shown), which may be of otherwise conventional configuration. Typically, each heat exchanger 47 may be formed as two stamped halves, e.g., half 47*a*, shown in FIG. 16, forming a tube, with the tube for the passage of the combustion products having what might be referred to as an "apostrophe"-shape. In cross-section (FIG. 17), each region of the heat exchanger has a greater height than width, with a generally pointed elliptical shape. The inlet 122 expands rapidly from circular opening 123 to a first section 124 which is substantially straight and has a substantially constant height, width and cross-section along its length. The transverse cross-sectional configuration of the heat exchanger tube has a substantially constant area in the first section 124.

A second arcuate section 126, which has a steadily decreasing height and width, and thus a generally decreasing cross-sectional area, ends in a truncated triangular outlet section 128, which ends in a flared exit opening 129. Each heat exchanger includes a pair of opposed indentations 130 which project into the interior of the heat exchanger. Indentations 130 are provided to maintained a desired flow velocity and distribute the flow of combustion gases evenly about the inner surface of the heat exchanger tube. Flow velocity is maintained, because the indentations reduce the transverse cross-sectional area of the passageway. At the same time, the surface area of the inner surface of the tube is increased, which enhances heat transfer from the combustion gases, through the heat exchanger walls, to the air being heated.

Figure 17:
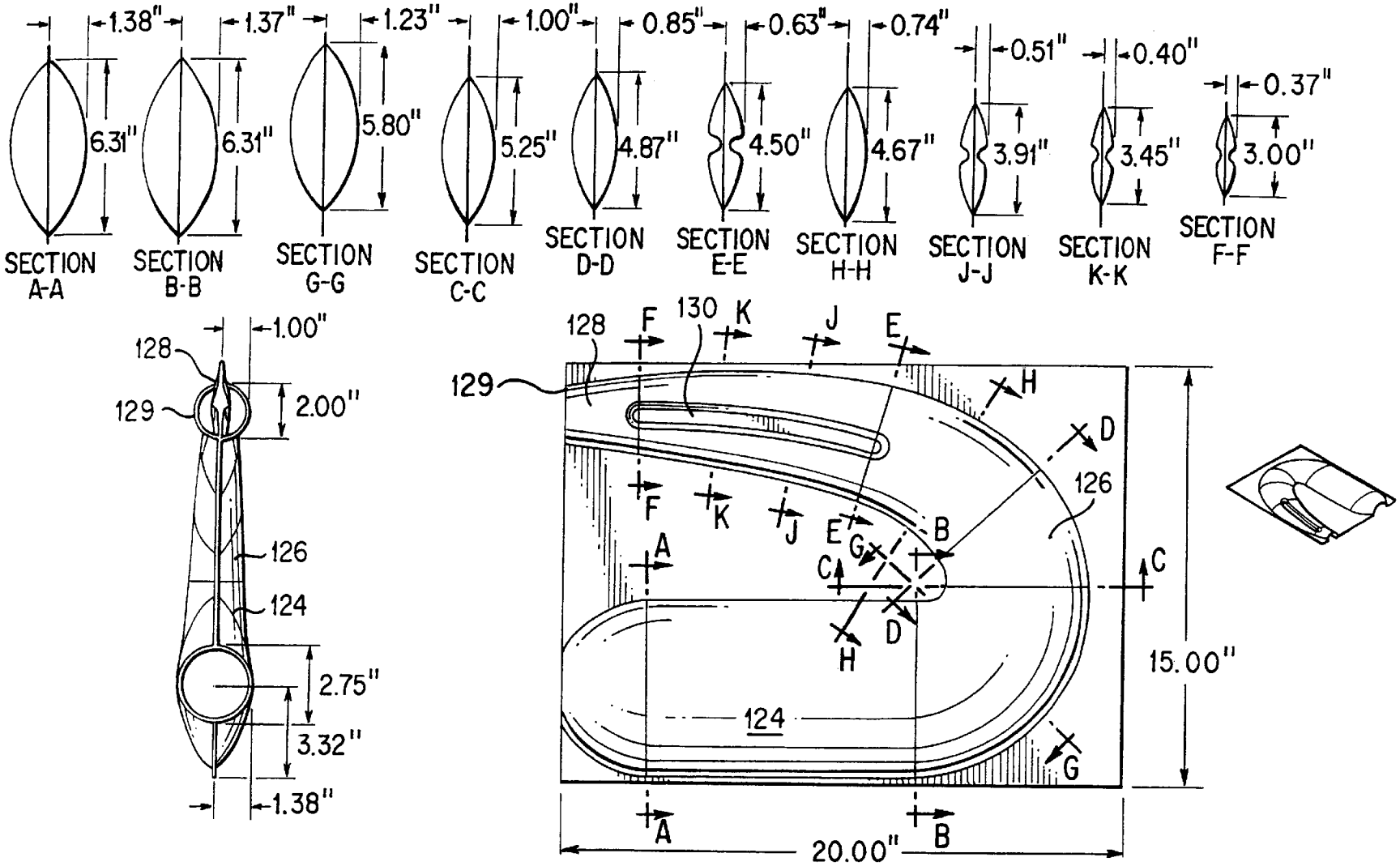
FIG. 17 is a detailed illustration of the cross-sectional configuration of the heat exchanger of FIGS. 13–16, showing the cross-sections at various locations.

FIG. 17 illustrates in detail, the contours of a heat exchanger 47, providing representative values for the contours. Although specific numerical values are given, these may be somewhat modified according to the requirements of a particular application, in accordance with the principles of the present invention, by one of ordinary skill in the art having the present disclosure before them, without departing from the scope of the invention.

The outlets 128 of the individual heat exchangers all connect to a common collection duct 132, in which a flow inducer fan 134 is located, preferably at the exit, to draw the combustion gases through the heat exchangers. After exiting the collection duct, the collected combustion gases are directed to a chimney or flue, which may be of otherwise conventional configuration.

By reducing the number of turns in the heat exchanger tube from several, to one bend and one gradual curve, thermal stresses in the bending regions, which can fatigue the sheet metal forming the tube, are reduced, thus lengthening the useful lifespan of the heat exchanger.

Figure 18:
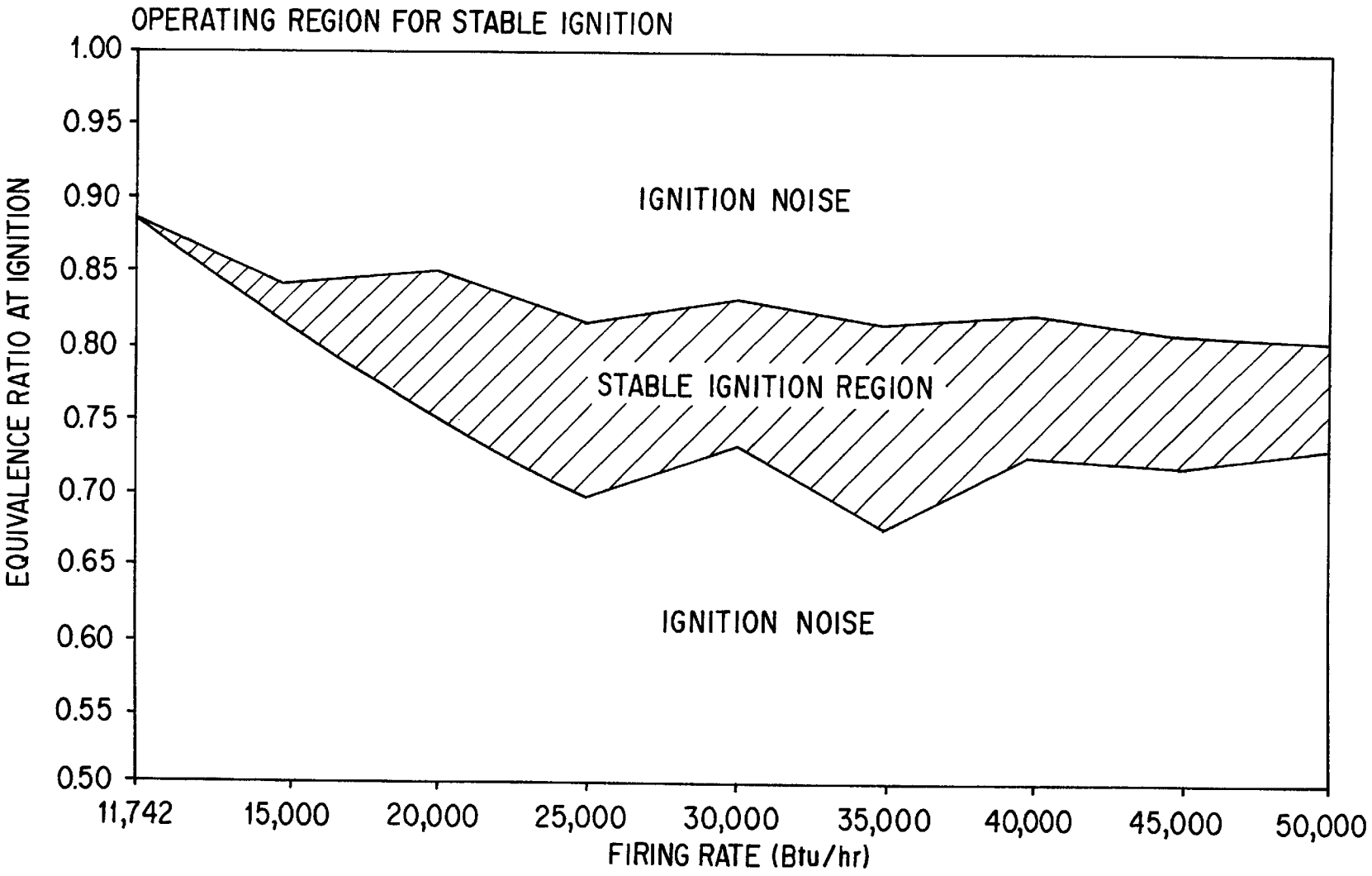
FIG. 18 is a plot of observed performance of a burner in accordance with the principles of FIGS. 8 and 9.

FIG. 18 illustrates noted performance of a burner having flame holders such as shown and described with respect to FIGS. 8 and 9.

Figure 19:
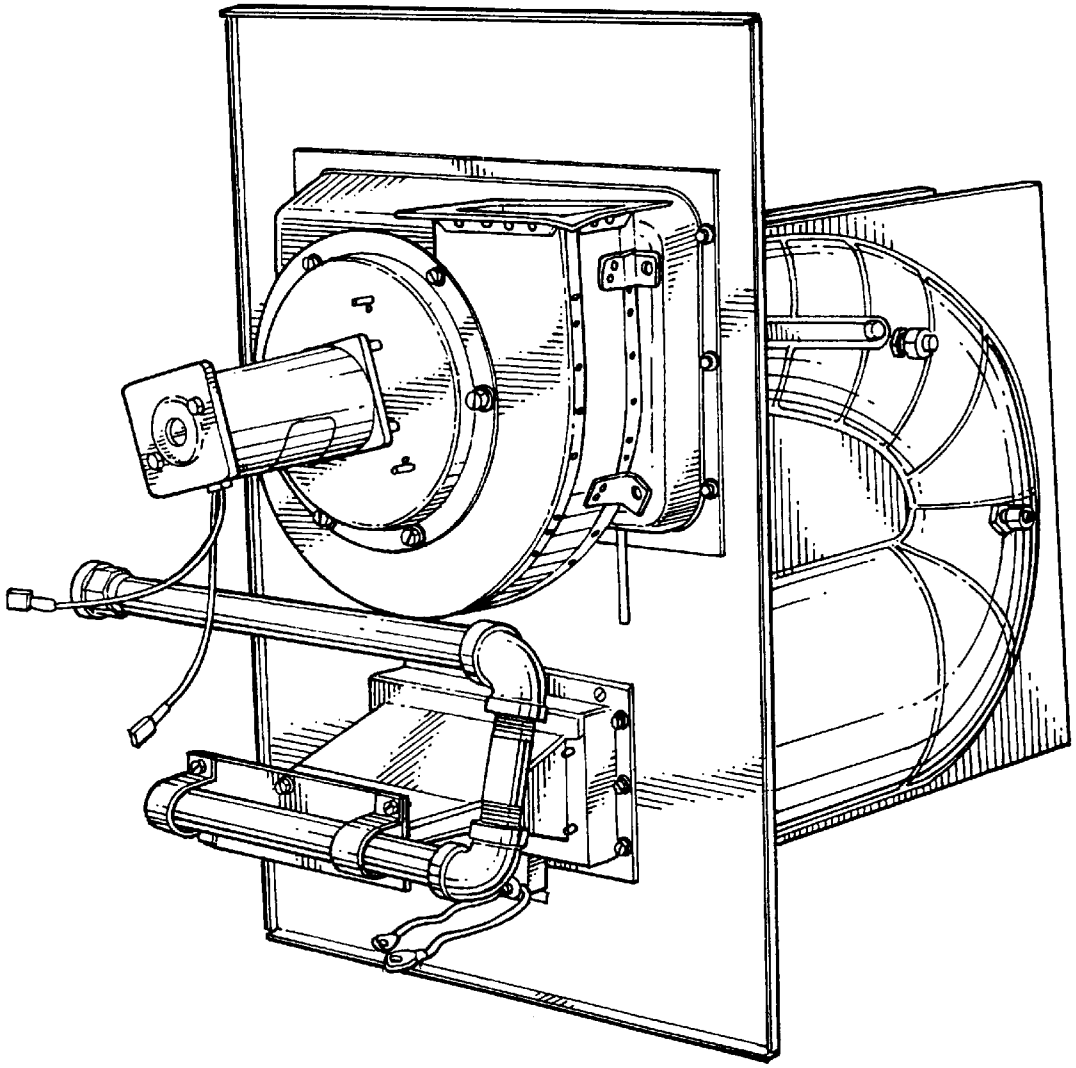
FIG. 19 is a perspective view of a heat exchanger, plenum, collection box and inducer fan, in accordance with the principles of the present invention.
Figure 20:
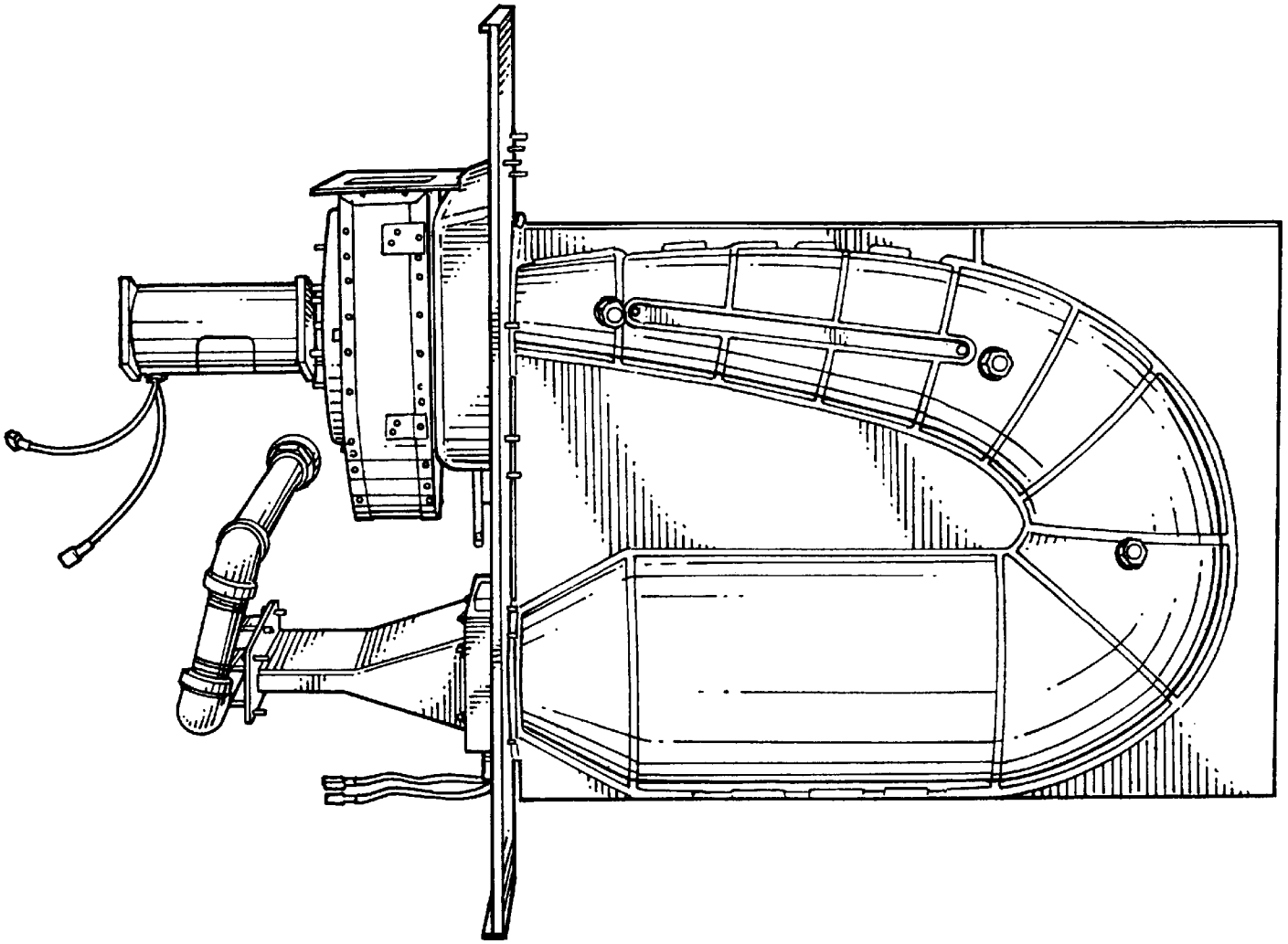
FIG. 20 is a side elevation of the apparatus of FIG. 19.

FIGS. 19–20 illustrate an example of a plenum/heat exchanger apparatus in accordance with the principles of the present invention.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. A burner plenum, for use with a burner apparatus, configured for receiving combustion air and gaseous fuel from a gaseous fuel manifold, for mixing same for delivery to a desired location for ignition of the mixed gaseous fuel and combustion air, for promoting the production of a stabilized flame for providing heat to be transferred to a location remote from the burner apparatus, comprising:

a plurality of side walls, defining an interior volume comprising a mixing region having a substantially constant width and a substantially constant thickness and a pressure recovery region disposed downstream from the mixing region, having a substantially constant width;

an inlet plate, connected to the side walls at one end of the burner plenum, and having means for enabling injection of gaseous fuel from at least one gaseous fuel outlet into the interior volume of the burner plenum, the inlet plate further having means for enabling ambient air to be drawn into the interior volume of the burner plenum by a suction source disposed downstream of the burner plenum.

2. The burner plenum according to claim 1, wherein the means for enabling injection of gaseous fuel comprises:

at least one gas inlet aperture disposed in the plate member, for receiving therethrough a jet of gaseous fuel being emitted from at least one gaseous outlet of a gaseous fuel manifold.

3. The burner plenum according to claim 2, wherein the means for enabling ambient air to be drawn into the plenum comprises:

a plurality of air inlet apertures, substantially surrounding the at least one gas inlet aperture, so that ambient air can be drawn into the interior volume of the burner plenum by a suction source disposed downstream of the burner plenum.

4. The burner plenum according to claim 1, wherein the interior volume further includes a pressure recovery region, the burner plenum further comprising:

a baffle member, positioned within the pressure recovery region of the interior volume, for facilitating distribution of the mixed gaseous fuel and combustion air across the width of the burner plenum and for facilitating distribution of the mixed fuel and air across a burner plate disposed in an outlet region of the burner plenum.

5. A burner plenum, for use with a burner apparatus, configured for receiving combustion air and gaseous fuel from a gaseous fuel manifold, for mixing same for delivery to a desired location for ignition of the mixed gaseous fuel and combustion air, for promoting the production of a stabilized flame for providing heat to be transferred to a location remote from the burner apparatus, comprising:

a plurality of side walls, defining an interior volume;

an inlet plate, connected to the side walls at one end of the burner plenum, and having means for enabling injection of gaseous fuel from at least one gaseous fuel outlet into the interior volume of the burner plenum, the inlet plate further having means for enabling ambient air to be drawn into the interior volume of the burner plenum by a suction source disposed downstream of the burner plenum, wherein the side walls defining the interior volume of the burner plenum, further comprise:

a mixing region having a substantially constant width and a substantially constant thickness; and a pressure recovery region disposed downstream from the mixing region, having a substantially constant width and a substantially continuously increasing thickness.

6. The burner plenum according to claim 5, wherein the side walls of the burner plenum defining the pressure recovery region are operably configured for association with a burner plate, for directing mixed gaseous fuel and combustion air to the burner plate.

* * * * *